US005307117A

United States Patent [19]

Harlan

[11] Patent Number: 5,307,117

[45] Date of Patent: Apr. 26, 1994

[54] PROTECTIVE SHIPPING COVER FOR CRU

[75] Inventor: Andrij Harlan, Rochester, N.Y.

[73] Assignee: Xerox Corporation, Stamford, Conn.

[21] Appl. No.: 986,659

[22] Filed: Dec. 8, 1992

[51] Int. Cl.[5] ..... G03G 15/00; B65D 43/14

[52] U.S. Cl. ..... 355/200; 206/389; 206/521; 220/339

[58] Field of Search ..... 220/4.23, 672, 675, 220/339; 206/408, 389, 521; 355/200, 260, 210

[56] References Cited

U.S. PATENT DOCUMENTS

| | | | |
|---|---|---|---|
| 3,985,257 | 10/1976 | Schaffer et al. | 220/672 X |
| 4,109,790 | 8/1978 | Gottschlich | 220/4.23 X |
| 4,132,344 | 1/1979 | Jewell | 229/2.5 R |
| 4,139,093 | 2/1979 | Holmes | 220/339 X |
| 4,375,262 | 3/1983 | Hrenyo | 220/4.23 X |
| 4,555,023 | 11/1985 | Sykes et al. | 220/339 X |
| 4,655,578 | 4/1987 | Kurtz et al. | 355/212 |
| 4,840,276 | 6/1989 | George | 206/521 X |
| 4,863,054 | 9/1989 | Capetta | 220/339 X |
| 5,021,828 | 6/1991 | Yamaguchi et al. | 355/209 |
| 5,090,570 | 2/1992 | Todd | 206/521 X |
| 5,094,355 | 3/1992 | Clark et al. | 220/4.23 |
| 5,131,212 | 7/1992 | Grey et al. | 53/472 |
| 5,131,543 | 7/1992 | Stephens | 206/523 |
| 5,146,732 | 9/1992 | Grey et al. | 53/472 |
| 5,153,643 | 10/1992 | Nagakura | 355/260 X |
| 5,176,272 | 1/1993 | Ryan | 220/4.23 |

*Primary Examiner*—A. T. Grimley
*Assistant Examiner*—Nestor R. Ramirez

[57] ABSTRACT

A durable, reuseable shipping cover for recycleable, modular customer replaceable units (CRU) of an electrophotographic printing machine. The cover is made of a durable material and, having a hinge formed integrally into the cover, wraps around a CRU in a clamshell like manner and is attached by recloseable tabs. Lugs molded into the cover interfit with voids in the CRU to assure proper alignment thereto. The cover has protective ribs molded into it to protect the CRU, particularly the photosensitive drum of a xerographic module, and give the cover structural strength. The cover is easily attached to the CRU and contains instructions for its use. The cover can also be easily reattached to a CRU that is being returned to a manufacturer for refurbishing to protect the reuseable portions thereof. When received by the manufacturer, the cover is removed, washed and reused to ship new or refurbished CRU's.

7 Claims, 4 Drawing Sheets

PROTECTIVE SHIPPING COVER FOR CRU

This invention relates generally to a protective, reuseable shipping cover, and more particularly concerns a reuseable protective shipping cover for use with customer replaceable units (CRU) in an electrophotographic printing machine.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Recently, electrophotographic printing machines have been developed which use one or more replaceable sub-assemblies called customer replaceable units (CRU). One typical CRU contains the machine photoreceptor and the necessary supporting hardware therefor assembled in a single unit designed for insertion and removal into and out of the machine by the user. When the cartridge is no longer operational, the old cartridge is removed and a new one installed. Other replaceable cartridges including the developer cartridges, toner supply cartridges, etc. may also be envisioned for this purpose. In an effort to become environmentally more responsible, many of the CRU's are now recycleable in that they may be returned to the manufacturer, refurbished and then resold to the customer.

Particularly, with respect to the cartridge containing the machine photoreceptor, it is important that the photoreceptor drum does not become damaged during transport. This is an absolute necessity for new CRU's but is also beneficial to the used CRU's being returned for recycling as the less damage that is sustained by the photoreceptor drum, the easier and more economically it may be recycled into a new product. It is also desirous to provide a protective shipping cover which itself would be reusable and recyclable and thus not contribute to the growing waste problem.

The following disclosures may be relevant to various aspects of the present invention:

U.S. Pat. No. 5,021,828
Patentee: Yamaguchi, et al.
Issue Date: Jun. 4, 1991
U.S. Pat. No. 4,132,344
Patentee: Jewell
Issue Date: Jan. 2, 1979
U.S. Pat. No. 5,131,212
Patentee: Grey, et al.
Issue Date: Jul. 21, 1992
U.S. Pat. No. 5,146,732
Patentee: Grey, et al.
Issue Date: Sep. 15, 1992

U.S. Pat. No. 5,131,543
Patentee: Stephens
Issue Date: Jul. 21, 1992

The relevant portions of the foregoing disclosures may be briefly summarized as follows:

U.S. Pat. No. 5,021,828 describes an electrophotographic printing machine having consumable customer replaceable units, which units are replaced as they are worn out by the customer.

U.S. Pat. No. 4,132,344 describes a foam sandwich package having a dish section and a cover section and a latching mechanism which dish section and cover section may be hingedly connected to each other.

U.S. Pat. No. 5,131,212 describes a cushioned shipping assembly having a carton and foam inserts to support a product shipped by supplier which elements are successively returned to be reused in the same or other shipping assembly.

U.S. Pat. No. 5,146,732 describes a cushioned shipping assembly including a carton and foam inserts to support a product shipped by a supplier which elements are successively returned by an end user to be reused in the same or other shipping assembly.

U.S. Pat. No. 5,131,543 describes a dissembleable and reusable package provided for static debris and shock sensitive objects. The package comprises a folding box and having an interlocking bottom, an open top and two pairs of parallel opposite sides and including a shock absorbing pad structure which fits against the central portions of the sides.

In accordance with one aspect of the present invention, there is provided An apparatus for protecting a cartridge having a sensitive member therein during the shipment thereof. The apparatus comprises a member having substantially semi-rigid portions, the member being wrapped around the cartridge to protect at least the sensitive member and means, integral with the member, for locating the member in a selected orientation on the cartridge. Means, integral with the member, for removably attaching the member to the cartridge so as to allow the member to be reused is also provided.

Other features of the present invention will become apparent as the following description proceeds and upon reference to the drawings, in which.

Figure 1:
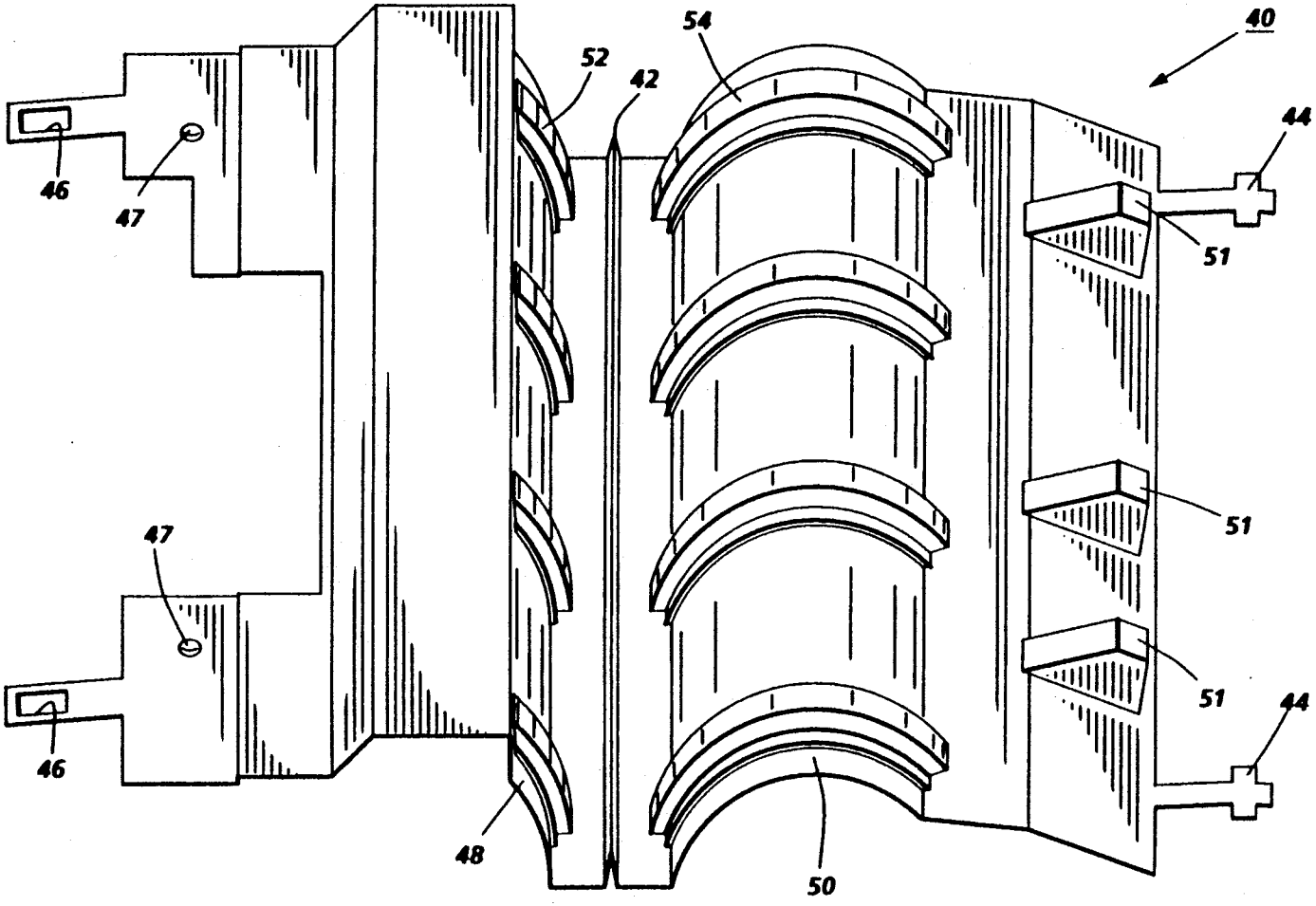
FIG. 1 is a perspective view of the CRU protective shipping cover of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

In the drawings and the following description, it is to be understood that like numeric designations refer to components of like function. Although specific terms are used in the following description for the sake of clarity, these terms are intended to refer only to the particular structure of the invention selected for illustration in the drawings, and are not intended to define or limit the scope of the invention.

Figure 4:
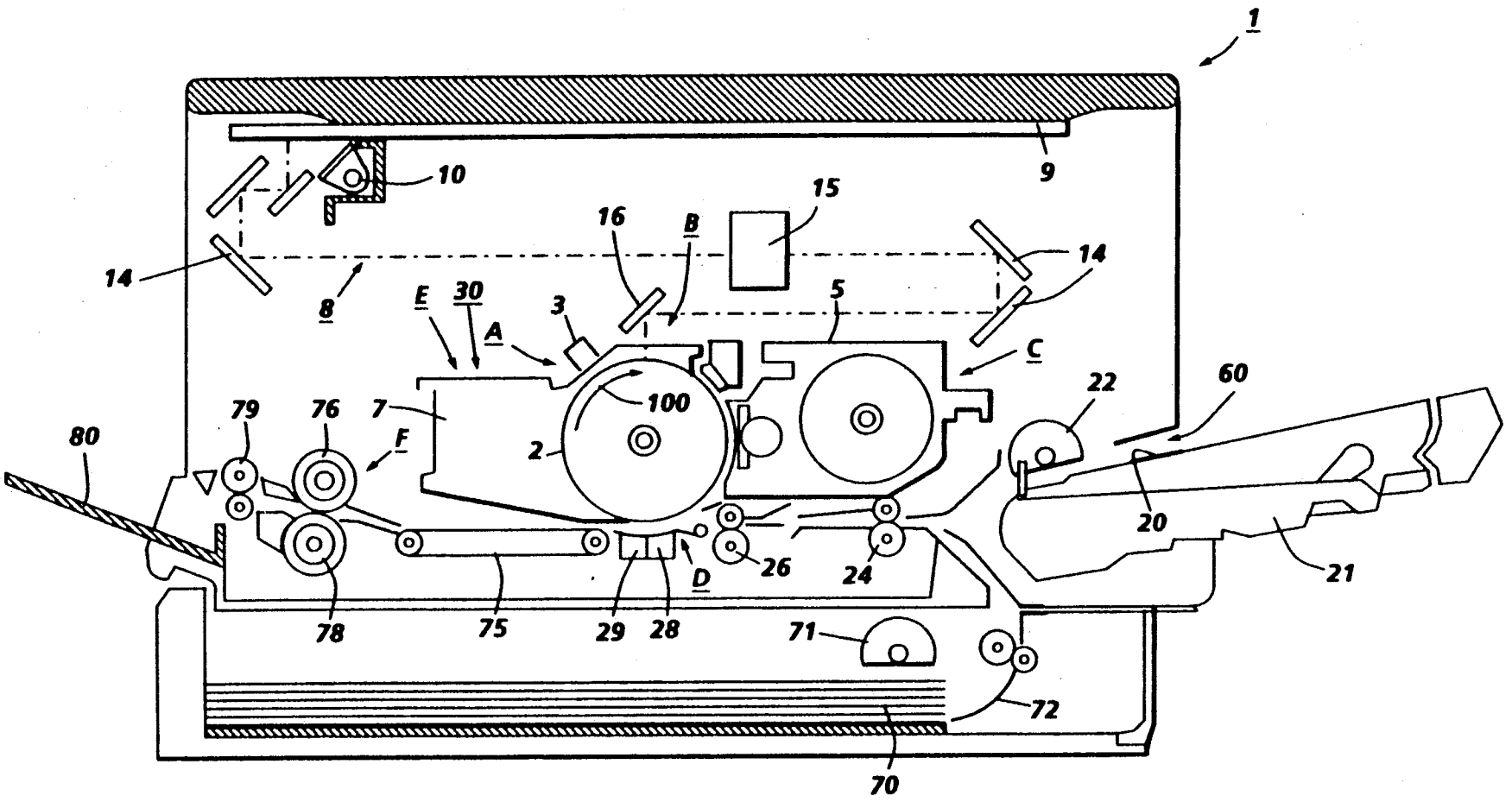
FIG. 4 is a schematic elevational view of a electrophotographic printing machine utilizing the customer replaceable unit which is protected by the invention herein.

Turning first to FIG. 4, there is illustrated a printing machine which utilizes a CRU of the type which is protected during shipment by the invention herein. Although the present invention is particularly well suited for use in an electrophotographic copying machine, it is equally well adapted for use with any number of devices, i.e. any device having replaceable modules requiring protection during the shipment thereof.

Referring first to FIG. 4, the electrophotographic copying machine 1 includes a photosensitive drum 2 which is rotated in the direction indicated by the arrow 100 so as to pass sequentially through a series of xerographic processing stations; a charge station A, an imaging station B, a developer station C, a transfer station D and a cleaning station E. The drum 2, corona generating device 3, and cleaning housing 7, form a unit that is produced as a single module known as a customer replaceable unit (CRU) generally referred to as reference numeral 30, which is detachably mounted to the apparatus main body and is replaceable by the customer.

Initially drum 2 rotates a portion of the photoconductive surface to a charging station A. Charging station A employs a corona generating device indicated generally by the reference numeral 3, to charge the photoconductive surface to a relatively high, substantially uniform potential.

Thereafter, drum 2 rotates the charged portion of the photoconductive surface to exposure station B. Exposure station B includes an exposure mechanism indicated generally by the reference numeral 8 having a stationary, transparent platen 9, such as a glass plate or like for supporting an original document thereon. Lamp 10 illuminates the original document. Scanning of the original document is achieved by translating the lamp in a time relationship with the movement of drum 2 so as to create incremental light images which are reflected upon a fixed mirror 16 via mirrors 14 and an optical lens 15 onto the charged portion of the photosensitive drum 2. Irradiation of the charged portion of the photoconductive surface of the drum 2 records an electrostatic image corresponding to the informational areas contained within the original document. Obviously, electronic imaging of the page information could be facilitated by a printing apparatus utilizing electrical imaging signals. The printing apparatus can be a digital copier including an input device, such as a raster output scanner (ROS), or, a printer utilizing a printer output device such as a ROS.

Subsequently, the electrostatic latent image is developed at developer station C. At the developer station, developer material from a developer housing 5 is caused to flow in contact with the surface of the drum 2. The developer material in the form of charged toner particles, is attracted to the image area of the drum 2 to form a visible toner image. The surface of the moving drum 2 then transports the toner image to transfer station D. Cut sheets of support material 20 are fed from the input tray 21 by sheet feeder 22 to the transfer station D via delivery rollers 24 and timing rollers 26 in synchronous relationship with the image on the surface of the drum 2. The backside of the sheet is sprayed with ions discharged from a transfer corotron 28 inducing on the sheet a charge having a polarity and magnitude sufficient to attract the toner material from the surface of the drum 2 to the sheet. The induced charge also electrostatically tacks the sheet to the drum 2. Subsequently, a second transfer corotron 29 induces an opposite charge on the sheet to facilitate the removal of the sheet from the surface of the drum 2. Also, to facilitate removal of the sheet, a stripper finger (FIG. 3 reference numeral 36) may be utilized to move between the drum 2 and the sheet of support material 20 to lift the sheet from the surface of the drum 2. In the illustration of FIG. 4, a sheet of support material may either be fed from the manual input 60, from the input tray 21, or from an auxiliary second input tray 70 by feeder 71 along path 72 to the aforementioned delivery rollers 24 and timing rollers 26.

The surface of the drum 2 continues along its rotational path passing cleaning station E, whereat the residual toner remaining on the surface of the drum 2 is removed prior to the charging thereof at charging station A. At the cleaning station E, the residual toner is mechanically cleaned from the surface of the drum 2, by means of a blade (FIG. 3 reference numeral 32) or the like. The toner is then collected within the cleaning housing 7. The residual toner may be collected and transported back to the developer housing 5 by suitable means, such as a conveyor moving in an endless loop through a tube. The collected residual toner can then be deposited in the developer mix within the developer housing 5 so that it can be reused in the developing process.

Following transfer and stripping, the sheet is transferred along transfer belt 75 to fusing station F. The fusing station F comprises an upper fuser roll 76 and a lower fuser roll 78 mounted in operative relation to each other and arranged to interact so as to support of the sheet of support material in a pressure driving contact therebetween. At least one of the two rolls (as shown, the upper roll 76), with the other roll typically being a simple pressure roller (as shown, the lower roll 78). As the heated roll 76 is rotated, the heated surface thereof is pressed into contact with the image face of the sheet. Mechanical and heat energy is transported from the roll surface to the support material permanently bonding the toner particles thereto. Upon leaving the fusing station F, the sheet having the image fixed thereto is discharged into a copy tray 80 by discharge rollers 79.

After producing the prescribed number of copies, the CRU 30 is replaced by the customer. The photosensitive drum 2 is very susceptible to damage and the new unit must be shipped in a protective covering so that the copy quality will not be impaired when the new CRU 30 is installed in the printing machine 1.

FIG. 1 illustrates the protective covering which is affixed to the new or reconditioned CRU 30 when the unit is prepared for shipment. Turning to FIG. 1, the cover 40 of the present invention is illustrated in perspective. The cover 40 is basically a clam-shelled type design, which has an integral hinge 42 at the center and is designed to be wrapped around the CRU 30 and attached by means of the attaching tabs 44 and eyelets 46. The cover 40 is manufactured from a durable, semi-rigid material, such as polyethylene and is constructed so as to protect the delicate photosensitive drum 2 and other fragile components of the CRU from damage during shipment. The semi-circular portions 48, 50 of the protective cover 40 can be seen. Each of these semi-circular portions 48, 50 has reinforcing ribs 52, 54 built into the section which prevent damage to the photoreceptive drum 2 and further provide structural rigidity and integrity to the cover unit 40.

Figure 2:
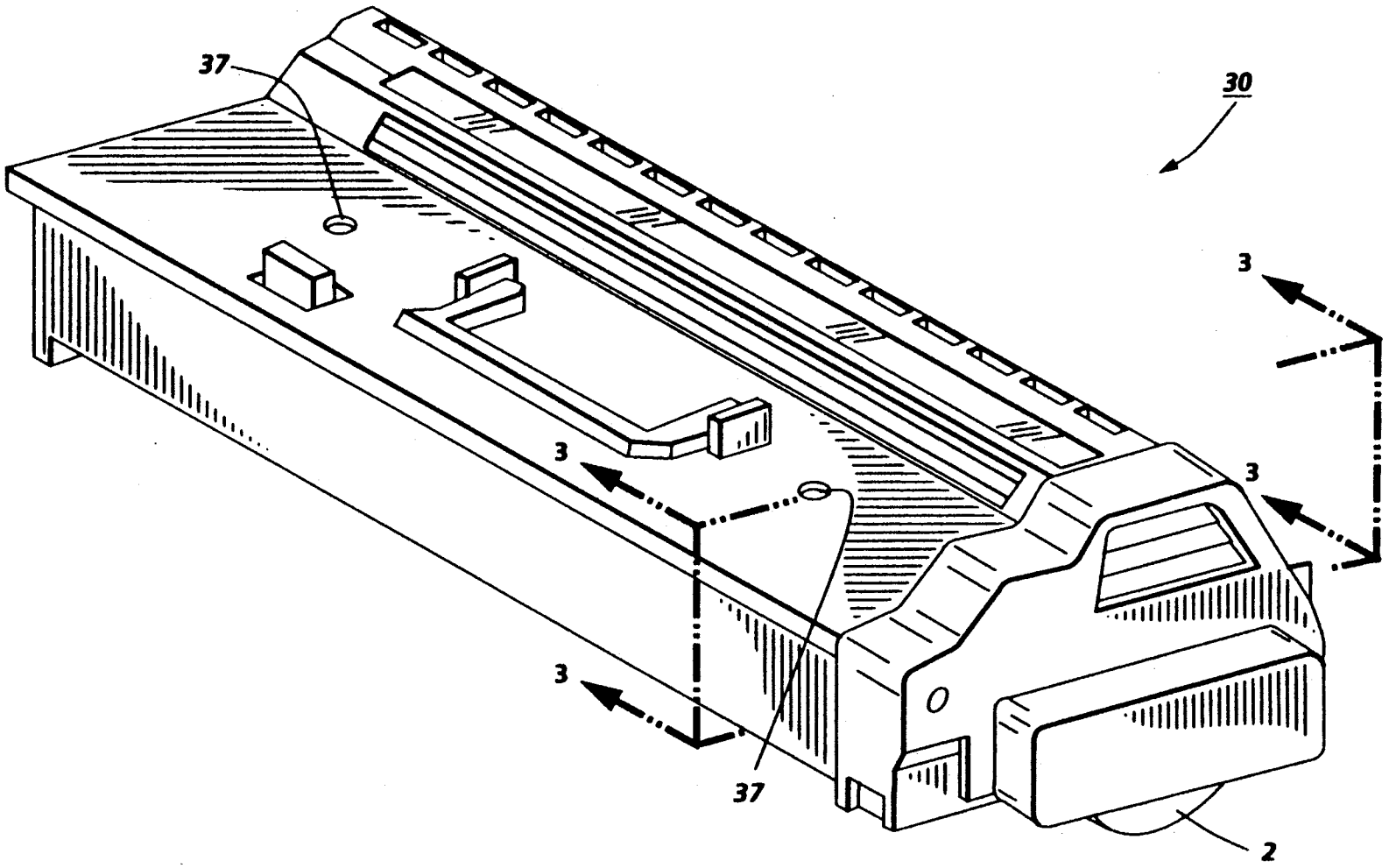
FIG. 2 is a perspective view of a cartridge adapted to have the FIG. 1 shipping cover wrapped thereabout.

FIG. 2 illustrates the xerographic CRU module 30. The photosensitive drum 2 can be seen protruding from the bottom portion of the CRU 30. It is this exposed portion of the drum 2 which must be protected from scratches and/or rough handling during the shipment thereof. The application of the cover to the CRU 30 is illustrated in FIG. 3.

Figure 3:
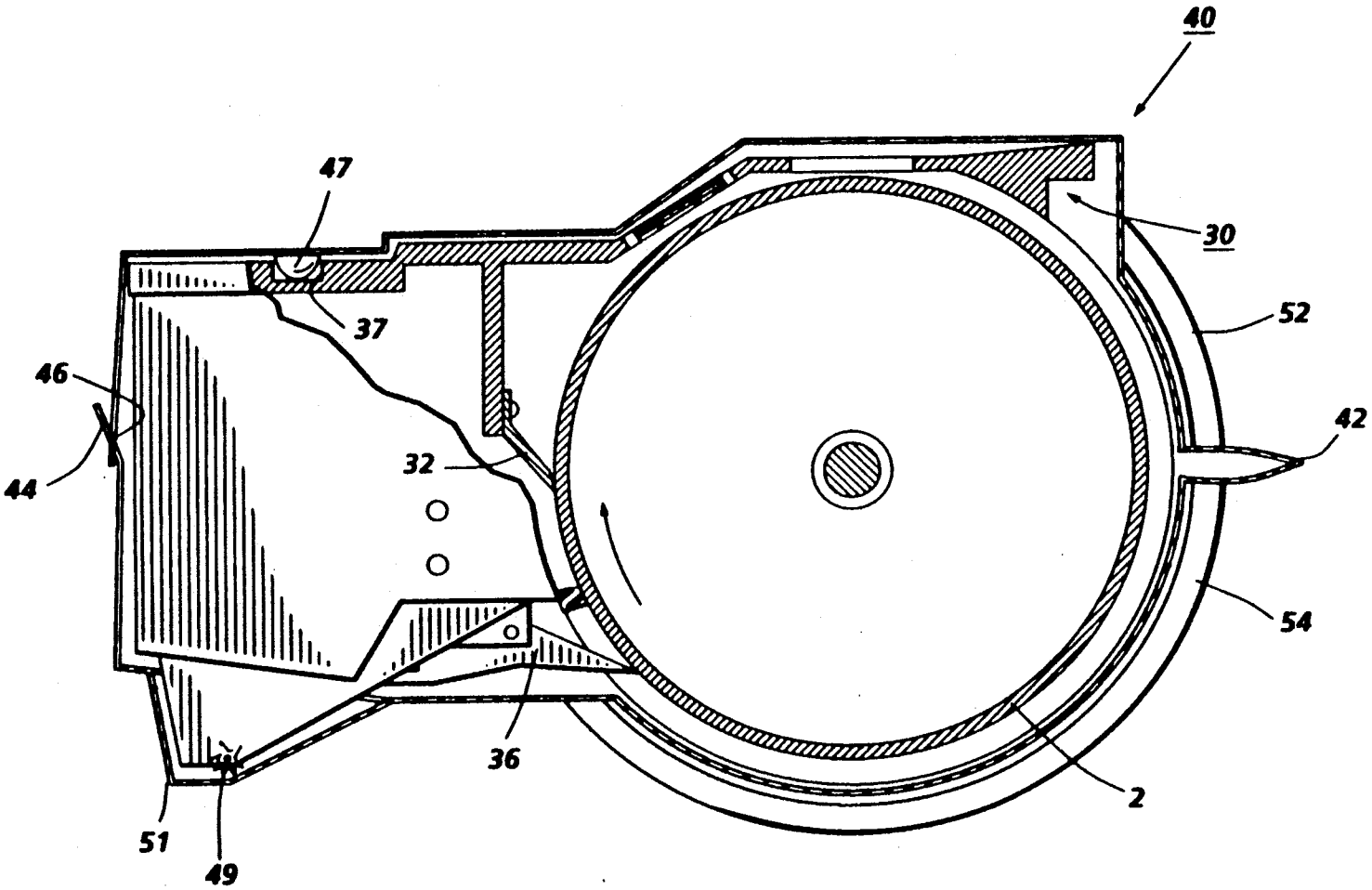
FIG. 3 is a sectional, elevational view of the protective cover installed on the FIG. 2 cartridge taken along the plane A—A in the direction of the arrows.

Turning to FIG. 3, the cover 40 is placed around the CRU 30 and is secured to the CRU 30 by means of locking tabs 44 and eyelets 46 which are interfit to hold the cover 40 securely to the CRU 30. Additionally, small lugs 47 are formed into the cover 40 which interlock into voids 37 (FIG. 3) in the CRU 30. These lugs 47 assure that the cover 40 is placed in the proper position to protect the CRU during shipment. The cover 40 also has molded portions 51 to fit over and protect the star wheels 49 which help guide the sheet to the fusing station F. When the CRU 30 is received by the customer, the protective cover 40 is removed from the CRU 30 and the CRU 30 is installed into the printing machine 1. The old CRU 30 is then sent back to the manufacturer for refurbishing. Due to the materials of which the cover 40 is manufactured, installation instructions and other shipping instructions can be embossed into the cover 40 at the time of manufacture. The cover 40 can then be installed on the used CRU 30 by the customer and returned to the manufacturer. When received by the manufacturer, the cover is removed, washed and reused to ship new or refurbished CRU's.

In recapitulation, there is provided a durable, reuseable shipping cover for modular components of an electrophotographic printing machine. The cover is easily attached to the CRU and contains instructions for its use. The cover can also be easily reattached to a CRU that is being returned to a manufacturer for refurbishing to protect the reuseable portions thereof.

It is, therefore, apparent that there has been provided in accordance with the present invention, a protective shipping cover for a CRU that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for protecting an image forming cartridge having a sensitive member therein during the shipment thereof, comprising:

a sheetlike member having substantially semi-rigid portions, said sheetlike member being wrapped around the cartridge to protect at least the sensitive member;

means, integral with said sheetlike member, for locating said member in a selected orientation on said cartridge, said locating means comprises protrusions extending outwardly from said sheet like member and being adapted to mate with corresponding apertures in the cartridge so as to accurately locate said sheet like member about the cartridge and maintain the orientation thereof; and means, integral with said sheetlike member, for removably attaching said sheetlike member to the cartridge so as to allow said member to be reused.

2. The apparatus according to claim 1, wherein said sheetlike member has regions formed therein corresponding to the shape of the cartridge.

3. The apparatus according to claim 2, wherein said regions formed in said sheet like member comprise cavities shaped in the configuration of said cartridge, particularly the sensitive regions thereof.

4. The apparatus according to claim 3, wherein said sheet like member further comprises reinforcing members formed integral therein so as to further protect said sensitive member.

5. The apparatus according to claim 4, comprising a hinge formed integrally therein dividing said sheet like member into a plurality of sections so as to wrap around the cartridge.

6. The apparatus according to claim 5, wherein said attaching means comprises:

a tab extending outwardly from a first marginal region of said sheetlike member, said tab defining an aperture therein; and a strap extending outwardly from a second marginal region, opposed from the first marginal region, of said sheetlike member, said strap member having an engagement means adapted to engage the aperture in said tab so as to secure said sheetlike member about the cartridge.

7. The apparatus according to claim 6, wherein said sheetlike member is made of polyethylene.

* * * * *